US006190844B1

(12) United States Patent
Dickerson et al.

(10) Patent No.: US 6,190,844 B1
(45) Date of Patent: Feb. 20, 2001

(54) METHOD OF PROVIDING DIGITAL IMAGE IN RADIOGRAPHIC FILM HAVING VISUALLY ADAPTIVE CONTRAST

(75) Inventors: Robert E. Dickerson, Hamlin; Phillip C. Bunch, Penfield, both of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/514,623

(22) Filed: Feb. 28, 2000

(51) Int. Cl.[7] ..... G03C 5/26

(52) U.S. Cl. ..... 430/359; 430/362; 430/363; 430/394

(58) Field of Search ..... 430/359, 362, 430/363, 394

(56) References Cited

U.S. PATENT DOCUMENTS

| | | | |
|---|---|---|---|
| 4,755,447 | 7/1988 | Kitts, Jr. | 430/139 |
| 4,803,150 | 2/1989 | Dickerson et al. | 430/502 |
| 4,900,652 | 2/1990 | Dickerson et al. | 430/502 |
| 4,994,355 | 2/1991 | Dickerson et al. | 430/509 |
| 4,997,750 | 3/1991 | Dickerson et al. | 430/509 |
| 5,021,327 | 6/1991 | Bunch et al. | 430/496 |
| 5,108,881 | 4/1992 | Dickerson et al. | 430/502 |
| 5,344,749 | 9/1994 | Kiekens et al. | 430/428 |
| 5,541,028 | 7/1996 | Lee et al. | 430/30 |
| 5,576,156 | 11/1996 | Dickerson | 430/502 |
| 5,667,944 * | 9/1997 | Reem et al. | 430/359 |
| 5,952,162 | 9/1999 | Dickerson et al. . | |

OTHER PUBLICATIONS

Visual optimization of radiographic tone scale, H–C Lee et al, SPIE vol. 3036, 1997.

Noise power spectrum analysis of a scanning microdensitomer, P.C. Bunch et al, Applied Optics, vol. 27, No.15, Aug. 15, 1988.

* cited by examiner

*Primary Examiner*—Hoa Van Le
(74) *Attorney, Agent, or Firm*—J. Lanny Tucker

(57) ABSTRACT

High performance radiographic films exhibit visually adaptive contrast when imaged in radiographic imaging assemblies comprising an intensifying screen on both sides. These films have at least two silver halide emulsions (preferably tabular grains) on each side of a film support, and the emulsion closest to the film support on each side includes chemistry to control crossover. In addition, the films can be rapidly processed to provide the desired image whereby the upper scale contrast is at least 1.2 times the lower scale contrast. Thus, dense objects can be better seen at the higher densities of the radiographic image without any adverse sensitometric changes in the lower scale densities. These films have greater dynamic range that allows them to be scanned and digitized to correct for under- or over-exposure.

17 Claims, 2 Drawing Sheets

METHOD OF PROVIDING DIGITAL IMAGE IN RADIOGRAPHIC FILM HAVING VISUALLY ADAPTIVE CONTRAST

FIELD OF THE INVENTION

This invention is directed to a method for providing digitized radiographic images using a radiographic film that can be directly viewed or further manipulated using digitization. In addition, the radiographic film used in this invention also has what is known as "visually adaptive contrast" because it can provide higher contrast than normal in the higher density regions of an image.

BACKGROUND OF THE INVENTION

Over one hundred years ago, W. C. Roentgen discovered X-radiation by the inadvertent exposure of a silver halide photographic element. In 1913, Eastman Kodak Company introduced its first product specifically intended to be exposed by X-radiation (X-rays). Today, radiographic silver halide films account for the overwhelming majority of medical diagnostic images. Such films provide viewable black-and-white images upon imagewise exposure followed by processing with the suitable wet developing and fixing photochemicals.

In medical radiography an image of a patient's anatomy is produced by exposing the patient to X-rays and recording the pattern of penetrating X-radiation using a radiographic film containing at least one radiation-sensitive silver halide emulsion layer coated on a transparent support. X-radiation can be directly recorded by the emulsion layer where only low levels of exposure are required. Because of the potential harm of exposure to the patient, an efficient approach to reducing patient exposure is to employ one or more phosphor-containing intensifying screens in combination with the radiographic film (usually both in the front and back of the film). An intensifying screen absorbs X-rays and emits longer wavelength electromagnetic radiation that the silver halide emulsions more readily absorb.

Another technique for reducing patient exposure is to coat two silver halide emulsion layers on opposite sides of the film support to form a "dual coated" radiographic film so the film can provide suitable images with less exposure. Of course, a number of commercial products provide assemblies of both dual coated films in combination with two intensifying screens to allow the lowest possible patient exposure to X-rays. Typical arrangements of film and screens are described in considerable detail for example in U.S. Pat. No. 4,803,150 (Dickerson et al), U.S. Pat. No. 5,021,327 (Bunch et al) and U.S. Pat. No. 5,576,156 (Dickerson).

One important component of the films described in these patents is a microcrystalline dye located in a silver halide emulsion layer or antihalation layer that reduces "crossover" (exposure of an emulsion from light emitted by an intensifying screen on the opposite of the film support) to less than 10%. Crossover results in reduced image sharpness. These microcrystalline dyes are readily decolorized during the wet processing cycle so they are not visible in the resulting image.

Radiographic films that can be rapidly wet processed (that is, processed in an automatic processor within 90 seconds and preferably less than 45 seconds) are also described in the noted U.S. Pat. No. 5,576,156. Typical processing cycles include contacting with a black-and-white developing composition, desilvering with a fixing composition, and rinsing and drying. Films processed in this fashion are then ready for image viewing. In recent years, there has been an emphasis in the industry for more rapidly processing such films to increase equipment productivity and to enable medical professionals to make faster and better medical decisions.

As could be expected, image quality and workflow productivity (that is processing time) are of paramount importance in choosing a radiographic imaging system [radiographic film and intensifying screen(s)]. One problem with known systems is that these requirements are not necessarily mutually inclusive. Some film/screen combinations provide excellent image quality but cannot be rapidly processed. Other combinations can be rapidly processed but image quality may be diminished. Both features are not readily provided at the same time.

In addition, the characteristic graphical plots [density vs. log E (exposure)] that demonstrate a film's response to a patient's attenuation of X-ray absorption indicate that known films do not generally provide desired sensitivity at the highest image densities where important pathology might be present. Traditionally, such characteristic sensitometric "curves" are S-shaped. That is the lower to midscale curve shape is similar to but inverted in comparison with the midscale to upper scale curve shape. Thus, these curves tend to be symmetrical about a density midpoint.

Another concern in the industry is the need to have radiographic films that as accurately as possible show all gradations of density differences against all backgrounds. It is well known that the typical response of the human eye to determining equal differences in density against a background of increasing density is not linear. In other words, typically it is more different for the human eye to see an object against a dark background than it is to see an object against a lighter background. Therefore, when an object is imaged (for example using X-rays, with or without intensifying screens) at the higher densities of the sensitometric curves, it is less readily apparent to the human eye when the radiographic film is being viewed. Obviously, this is not a desirable situation when medical images are being viewed and used for important diagnostic purposes.

In order to compensate for this nonlinearity of response by the human eye, it would be desirable to somehow increase radiographic film contrast only at the higher densities without changing contrast or other properties at lower densities. The result of such a modification would be a unique sensitometric curve shape where the contrast is higher than normal in the higher density regions. Such a curve shape is considered as providing "visually adaptive contrast" (VAC).

While this type of sensitometry sounds like a simple solution to a well known problem, achieving it in complicated radiographic film/screen systems is not simple and is not readily apparent from what is already known in the art. Moreover, one cannot predict that even if VAC is obtained with a particular radiographic film, other necessary image properties and rapid processability may be adversely affected.

Recent digital technologies in the photographic industry offer advantages in that they can enable the user to manipulate the images after wet processing by scanning to create a digital representation of the image. One of these advantages is the ability to readjust the exposure by automatic tone scaling to correct for either over- or underexposure. This is particularly useful in radiography where a patient is not available to have a second X-ray image taken (for example, the patient may be too ill), as in intensive care facilities. A problem with known digital modalities is that they do not provide the high image quality that high performance film/screen imaging assemblies are capable of.

In addition, while photographic film scanners are available today, and films scanning and digitization is common, existing radiographic films do not work will with known film scanning equipment. One limitation is that the scanned film must have sufficient exposure latitude so that information can be recovered digitally even if the film is over- or underexposed. It is thus necessary that the film exhibits sufficient contrast in the both the toe and shoulder regions of a characteristic sensitometric density vs. log E curve to capture image information.

Early attempts to accomplish this are described in U.S. Pat. No. 4,755,447 (Kitts, Jr.). The films described in this patent may be suitable for recovering information even if over- or underexposed, but their contrast was too low if directly viewed. In addition, films at a high density level are less useful because the image signals are dominated by electronic noise (see for example, Bunch et al, *Applied Optics*, Vol. 27, No. 16, pp. 3468–3474, 1988).

With these constraints in mind, there is a need for a means to provide high quality images that can be directly viewed as well as electronically scanned and digitized for further manipulation.

SUMMARY OF THE INVENTION

The present invention provides a solution to the noted problems with a method for providing a radiographic image comprising:

A) providing a black-and-white image by contacting an imagewise exposed radiographic film with wet processing chemistry, including a black-and-white developing composition, for 90 seconds or less, the black-and-white image having visually adaptive contrast whereby the upper scale contrast is at least 1.2 times the lower scale contrast of a sensitometric D vs. log E curve, and also being capable of maintaining a gamma of at least 2.5 up to 2.5 density units, B) scanning the black-and-white image obtained in A) to form density representative signals, and C) digitally manipulating the density representative signals obtained in B) to provide a digital record, the radiographic silver halide film comprising a support having first and second major surfaces and that is capable of transmitting X-radiation, the film having disposed on the first major support surface, two or more hydrophilic colloid layers including first and second silver halide emulsion layers, and on the second major support surface, two or more hydrophilic colloid layers including third and fourth silver halide emulsion layers, the first and third silver halide emulsion layers being closer to the support than the second and fourth silver halide emulsion layers, respectively each of the first, second, third and fourth silver halide emulsion layers comprising silver halide grains that (a) have the same or different composition in each silver halide emulsion layer, (b) account for at least 50% of the total grain projected area within each silver halide emulsion layer, (c) have an average thickness of less than 0.3 $\mu$m, and (d) have an average aspect ratio of greater than 5, all hydrophilic layers of the film being fully forehardened and wet processing solution permeable for image formation within 45 seconds, the first and third silver halide emulsion layers comprising at least one particulate dye that is (a) capable of absorbing radiation to which the silver halide emulsions are sensitive, (b) present in an amount sufficient to reduce crossover to less than 15%, and (c) capable of being substantially decolorized during wet processing.

Thus, the present invention provides means for obtaining radiographic images using a radiographic film (for example as part of a film/intensifying screen assembly) to give the medical professional a greater ability to see an object against a dark (or high density) background. Therefore, when an object is imaged using the film of this invention at the higher densities, the object is more readily apparent to the human eye.

In order to compensate for the nonlinearity of response by the human eye and the limitations of the film digitizer (i.e. scanner), the radiographic film contrast has been increased only at the higher densities without changing contrast or other properties at lower densities. The result of such a modification is a unique sensitometric curve shape where the contrast is higher than normal in the higher density regions. Thus, the films used in this invention are considered as providing "visually adaptive contrast" (VAC) as we have defined it.

In addition, all other desirable sensitometric properties are maintained, crossover is desirably low, and the films can be rapidly processed in conventional processing equipment and compositions. Because the wet processing time can be shortened, the time needed for image digitization can be more readily accommodated within overall image formation.

More importantly, the present invention provides wide latitude (that is, wide dynamic range) in radiographic imaging and thus enables the user to correct over- or underexposures by digital scanning and electronic manipulation. The films can also be directly viewed if desired. However, once the image is in digital form, exposure compensation can be carried out using conventional tone scaling algorithms without any loss in information. The particular films used in this invention are suitable for scanning in conventional scanning devices. Due to the high upper scale contrast, the images obtained by this method are less susceptible to film granularity at high densities.

DETAILED DESCRIPTION OF THE INVENTION

Figure 1:
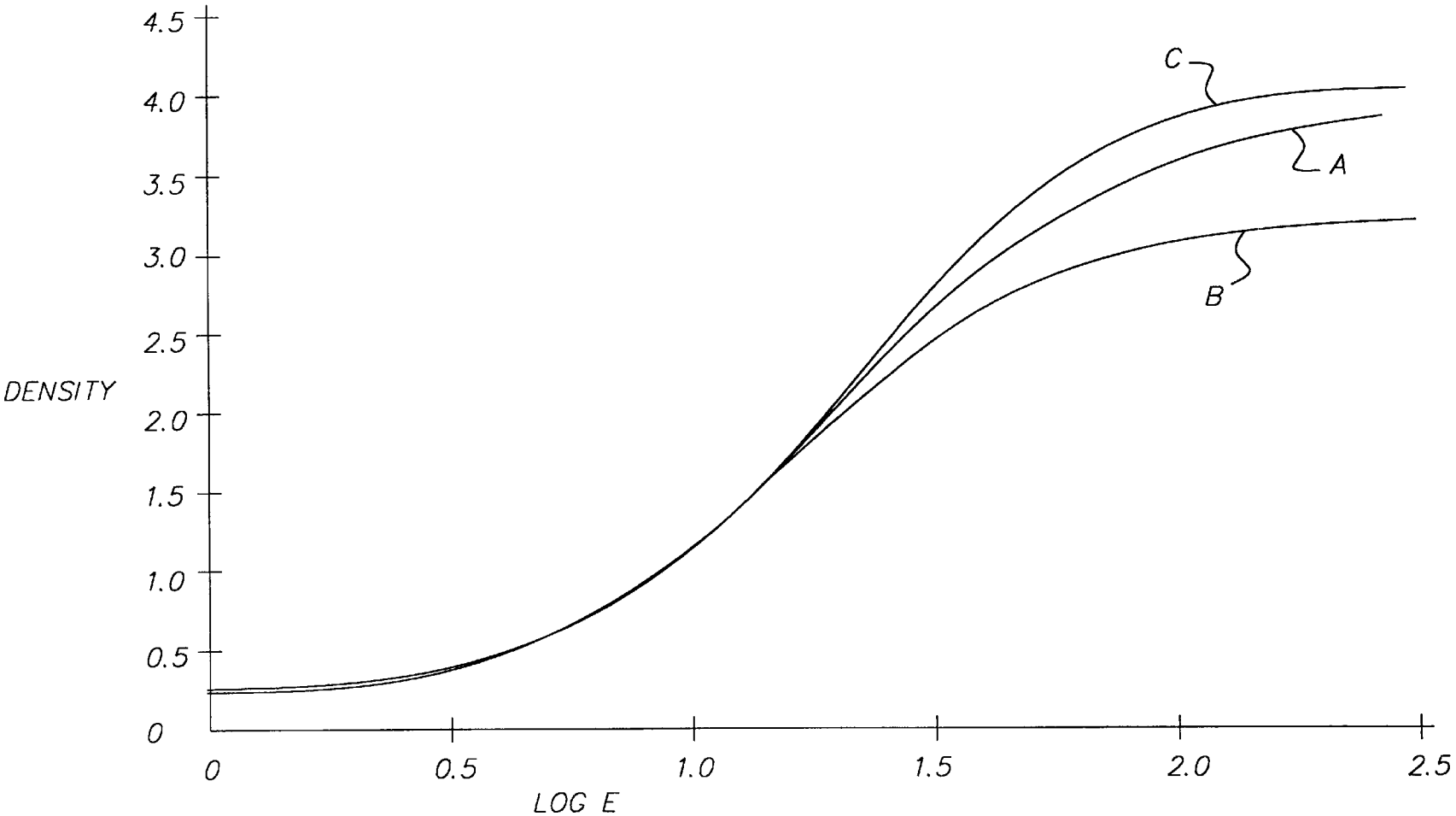
FIG. 1 is graphical representation of characteristic density vs. log E (exposure) for Films A, B and C of the Example described below.

The term "contrast" as herein employed indicates the average contrast (also referred to as $\gamma$) derived from a characteristic curve of a radiographic element using as a first reference point (1) a density ($D_1$) of 0.25 above minimum density and as a second reference point (2) a density ($D_2$) of 2.0 above minimum density, where contrast is $\Delta D$ (i.e. 1.75)$\div\Delta \log_{10}E$ ($\log_{10}E_2-\log_{10}E_1$), $E_1$ and $E_2$ being the exposure levels at the reference points (1) and (2).

"Lower scale contrast" is the slope of the characteristic curve measured between of a density of 0.85 to the density achieved by shifting −0.3 log E units.

"Upper scale contrast" is the slope of the characteristic curve measured between a density of 1.5 above $D_{min}$ to 2.85 above $D_{min}$.

"Dynamic range " refers to the range of exposures over which useful images can be obtained.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "tabular grain" is used to define a silver halide grain having two parallel crystal faces that are clearly larger than any remaining crystal faces and having an aspect ratio of at least 2. The term "tabular grain emulsion" refers to a silver halide emulsion in which the tabular grains account for more than 50% of the total grain projected area.

The term "covering power" is used to indicate 100 times the ratio of maximum density to developed silver measured in $mg/dm^2$.

The term "rare earth" is used to refer to elements having an atomic number of 39 or 57 to 71.

The term "front" and "back" refer to locations nearer to and further from, respectively, the source of X-radiation than the support of the film.

The term "dual-coated" is used to define a radiographic film having silver halide emulsion layers disposed on both the front- and backsides of the support.

The radiographic films useful in this invention include a flexible support having disposed on both sides thereof: two or more silver halide emulsion layers and optionally one or more non-radiation sensitive hydrophilic layer(s). The silver halide emulsions in the various layers can be the same or different, and can comprise mixtures of various silver halide emulsions in or more of the layers.

In preferred embodiments, the film has the same silver halide emulsion on both sides of the support, and closest to the support. The emulsion layers disposed farther from the support can also have the same silver halide emulsions. It is also preferred that the films have a protective overcoat (described below) over the silver halide emulsions on each side of the support.

The support can take the form of any conventional radiographic element support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports. *Research Disclosure* is published by Kenneth Mason Publications, Ltd., Dudley House, 12 North Street, Emsworth, Hampshire P010 7DQ England.

The support is a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the two or more silver halide emulsion layers on each side of the film support. This layer may be called an interlayer or overcoat, or both.

The silver halide emulsion layers comprise one or more types of silver halide grains responsive to X-radiation. Silver halide grain compositions particularly contemplated include those having at least 80 mol % bromide (preferably at least 98 mol % bromide) based on total silver. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total silver) to facilitate more rapid processing. Preferably iodide is limited to no more than 2 mol % (based on total silver) or eliminated entirely from the grains. The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains are tabular grains and the emulsions are tabular grain emulsions in each silver halide emulsion layer.

In addition, different silver halide emulsion layers can have silver halide grains of the same or different morphologies as long as at least 50% of the grains are tabular grains. For cubic grains, the grains generally have an ECD of at least 0.8 $\mu$m and less than 3 $\mu$m (preferably from about 0.9 to about 1.4 $\mu$m). The useful ECD values for other non-tabular morphologies would be readily apparent to a skilled artisan in view of the useful ECD values provided for cubic and tabular grains.

Generally, the average ECD of tabular grains used in the films is greater than 0.9 $\mu$m and less than 4.0 $\mu$m, and preferably greater than 1 and less than 3 $\mu$m. Most preferred ECD values are from about 1.6 to about 4.5 $\mu$m. The average thickness of the tabular grains is generally at least 0.1 and no more than 0.3 $\mu$m, and preferably at least 0.12 and no more than 0.18 $\mu$m.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

Generally, at least 50% (and preferably at least 90%) of the silver halide grain projected area in each silver halide emulsion layer is provided by tabular grains having an average aspect ratio greater than 5, and more preferably greater than 10. The remainder of the silver halide projected area is provided by silver halide grains having one or more non-tabular morphologies.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al), U.S. Pat. No. 4,425,426 (Abbott et al), U.S. Pat. No. 4,439,520 (Kofron et al), U.S. Pat. No. 4,434,226 (Wilgus et al), U.S. Pat. No. 4,435,501 (Maskasky), U.S. Pat. No. 4,713,320 (Maskasky), U.S. Pat. No. 4,803,150 (Dickerson et al), U.S. Pat. No. 4,900,355 (Dickerson et al), U.S. Pat. No. 4,994,355 (Dickerson et al), U.S. Pat. No. 4,997,750 (Dickerson et al), U.S. Pat. No. 5,021,327 (Bunch et al), U.S. Pat. No. 5,147,771 (Tsaur et al), U.S. Pat. No. 5,147,772 (Tsaur et al), U.S. Pat. No. 5,147,773 (Tsaur et al), U.S. Pat. No. 5,171,659 (Tsaur et al), U.S. Pat. No. 5,252,442 (Dickerson et al), U.S. Pat. No. 5,370,977 (Zietlow), U.S. Pat. No. 5,391,469 (Dickerson), U.S. Pat. No. 5,399,470 (Dickerson et al), U.S. Pat. No. 5,411,853 (Maskasky), U.S. Pat. No. 5,418,125 (Maskasky), U.S. Pat. No. 5,494,789 (Daubendiek et al), U.S. Pat. No. 5,503,970 (Olm et al), U.S. Pat. No. 5,536,632 (Wen et al), U.S. Pat. No. 5,518,872 (King et al), U.S. Pat. No. 5,567,580 (Fenton et al), U.S. Pat. No. 5,573,902 (Daubendiek et al), U.S. Pat. No. 5,576,156 (Dickerson), U.S. Pat. No. 5,576,168 (Daubendiek et al), U.S. Pat. No. 5,576,171 (Olm et al), and U.S. Pat. No. 5,582,965 (Deaton et al). The patents to Abbott et al, Fenton et al, Dickerson and Dickerson et al are also cited and incorporated herein to show conventional radiographic film features in addition to gelatino-vehicle, high bromide (≧80 mol % bromide) tabular grain emulsions and other features useful in the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure,* Item 38957, cited above, Section I. Emulsion grains and their preparation, sub-section D. Grain modifying conditions and adjustments, paragraphs (3), (4) and (5).

A general summary of silver halide emulsions and their preparation is provided by *Research Disclosure*, Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure,* Item 38957, Section IV. Chemical Sensitization. Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II. Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al), incorporated herein by reference.

The silver halide emulsion layers (and other hydrophilic layers) in the radiographic films are generally fully hardened using one or more conventional hardeners. Thus, the amount of hardener in each silver halide emulsion and other hydrophilic layer is generally at least 1.5% and preferably at least 2%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

On each side of the radiographic film, the minimal total level of silver is generally at least 15 mg/dm$^2$. In addition, the total coverage of polymer vehicle per side (that is, all layers on that side) is generally no more than 35 mg/dm$^2$, and preferably no more than 30 and generally at least 20 mg/dm$^2$. The amounts of silver and polymer vehicle on the two sides of the support can be the same or different. These amounts refer to dry weights.

The radiographic films generally include a surface protective overcoat on each side of the support that is typically provided for physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layer and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic films useful in this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

An essential feature of the radiographic films useful in this invention is the presence of one or more microcrystalline particulate dyes in the first and third silver halide emulsion layers (that is, those emulsion layers closest to and on opposing sides of the support). The presence of such dyes reduces crossover during film use in radiographic assemblies to less than 15%, preferably less than 10% and more preferably less than 5%. The amount in the film to achieve this result will vary on the particular dye(s) used, as well as other factors, but generally the amount of particulate dye is at least 0.5 mg/dm$^2$, and preferably at least 1 mg/dm$^2$, and up to 2 mg/dm$^2$.

The particulate dyes generally provide optical densities of at least 0.5, and preferably at least 1. Examples of useful particulate dyes and teaching of their synthesis are described in U.S. Pat. No. 5,021,327 (noted above, Cols. 11–50) and U.S. Pat. No. 5,576,156 (noted above, Cols. 6–7), both incorporated herein by reference for description of the dyes. Preferred particulate dyes are nonionic polymethine dyes that include the merocyanine, oxonol, hemioxonol, styryl and arylidene dyes. These dyes are nonionic in the pH range of coating, but ionic under the alkaline pH of wet processing. A particularly useful dye is 1-(4'-carboxyphenyl)-4-(4'-dimethylaminobenzylidene)-3-ethoxycarbonyl-2-pyrazolin-5-one (identified as Dye XOC-1 herein).

The dye can be added directly to the hydrophilic colloid as a particulate solid or it can be converted to a particulate solid after it has been added to the hydrophilic colloid, as described in U.S. Pat. No. 5,021,327 (Col. 49).

In addition to being present in particulate form and satisfying the optical density requirements described above, the dyes useful in the practice of this invention must be substantially decolorized during wet processing. The term "substantially decolorized" is used to mean that the density contributed to the image after processing is no more than 0.1, and preferably no more than 0.05, within the visible spectrum.

The films described herein exhibit an upper scale contrast (USC) of at least 2, and preferably at least 3. In addition, the ratio of USC to LSC is at least 1.2 and preferably at least 1.6. These features provide what is described above as visually adaptive contrast (VAC). This attribute is similar to "perceptually linearized contrast" or visually optimized tone scale as described for example by Lee et al, *SPIE* Vol. 3036, pp. 118–129, 1997.

Preferred films useful in this invention comprise a dual coated radiographic film comprising a light transmissive support and having disposed on each side thereof:

a first tabular grain silver bromide (at least 98 mol % bromide) emulsion layer comprising from about 1 to about 2 mg/dm$^2$ of a particulate microcrystalline dye that reduces crossover to less than 10%, a second silver halide grain emulsion layer comprising a mixture of two different tabular silver bromide (at least 98 mol % bromide) grain emulsions, a hydrophilic interlayer, and a hydrophilic overcoat, the total polymer vehicle on each side of the support being from about 20 to about 35 mg/dm$^2$.

The radiographic imaging assemblies useful in the present invention are composed of a radiographic film as described herein and intensifying screens adjacent the front and back of the radiographic film. The screens are typically designed to absorb X-rays and to emit electromagnetic radiation having a wavelength greater than 300 nm. These screens can take any convenient form providing they meet all of the usual requirements for use in radiographic imaging, as described for example in U.S. Pat. No. 5,021,327 (noted above), incorporated herein by reference. A variety of such screens are commercially available from several sources, including by not limited to, LANEX™, X-SIGHT™ and InSight™ Skeletal screens available from Eastman Kodak Company. The front and back screens can be appropriately chosen depending upon the type of emissions desired, the photicity desired, whether the films are symmetrical or assymmetrical, film emulsion speeds, and crossover.

Exposure and processing of the radiographic films can be undertaken in any convenient conventional manner. The exposure and processing techniques of U.S. Pat. Nos. 5,021,327 and 5,576,156 (both noted above), are typical for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference. The processing compositions can be supplied as single- or multi-part formulations, and in concentrated form or as more diluted working strength solutions.

It is particularly desirable that the films described herein be processed within 90 seconds, and preferably from about 30 to about 60 seconds, including developing, fixing and any washing (or rinsing). Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al). Preferably, the black-and-white developing compositions used during processing are free of any photographic film (for example, gelatin) hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dry processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing step. Typical black-and-white developing and fixing compositions are described in the Example below.

Radiographic kits useful in the practice of the present invention can include one or more samples of radiographic film, one or more intensifying screens used in the radiographic imaging assemblies, and/or one or more suitable processing compositions. Preferably, the kit includes all of these components.

The processed films described herein can be scanned immediately after black-and-white development or after partial of complete fixing. Preferably, both development and fixing are carried out prior to scanning.

The resulting black-and-white image is scanned point-by-point, line-by-line or frame-by-frame using any suitable scanning device (such as the Lumiscan 75 available from Lumisys) to produce "density representative signals". The digital record so produced can then be read into any convenient memory medium (for example, an optical disk, computer hard drive, or magnetic storage media) or transmitted to other medical institutions or users for future digital manipulation, or immediate use (for example diagnosis) to correct any under- or overexposures. A user would know how much exposure correction to make by looking at the image and adjusting the exposure levels. Alternatively, an example of software useful for this purpose is RV-2000 DICOM Viewing Software available from Lumisys.

The corrected digital signals (that is, the digital records) can also be forwarded to a suitable output device to provide a display image or stored for future use. The output device may take a number of forms such as a CRT display, CD disk, magnetic storage devices or other type of storage or output device readily apparent to one skilled in the art.

Besides digital manipulation, the digital images can be used to change physical characteristics of the image, such as "windowing" and "leveling" (used in computed tomography scanning) or other manipulations known in the art.

The following example is provided for illustrative purposes, and is not meant to be limiting in any way.

EXAMPLE

Radiographic Film A (Control):

Radiographic Film A was a dual coated having silver halide emulsions on both sides of a blue-tinted 178 $\mu$m transparent poly(ethylene terephthalate) film support. Each silver halide emulsion layer contained a green-sensitized mixture of two different high aspect ratio tabular silver bromide emulsions. The emulsions were chemically sensitized with sodium thiosulfate, potassium tetrachloroaurate, sodium thiocyanate and potassium selenocyanate, and spectrally sensitized with 400 mg/Ag mole of anhydro-5,5-dichloro-9-ethyl-3,3'-bis(3-sulfopropyl)oxacarbocyanine hydroxide, followed by 300 mg/Ag mole of potassium iodide.

Radiographic Film A had the following layer arrangement on each side of the film support:

Overcoat

Interlayer

High Contrast Emulsion Layer

Crossover Control Layer

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 $\mu$m) | 0.11 |
| Carboxymethyl casein | 0.57 |
| Colloidal silica (LUDOX AM) | 0.57 |
| Polyacrylamide | 0.57 |
| Chrome alum | 0.025 |

-continued

| | Coverage (mg/dm$^2$) | |
|---|---|---|
| Resorcinol | 0.058 | |
| Nitron | 0.044 | |
| High Contrast Emulsion Layer Formulation | | |
| T-grain emulsion (AgBr 2.7 × 0.13 μm) | 9.5 | |
| T-grain emulsion (AgBr 2.0 × 0.10 μm) | 14.2 | |
| Gelatin vehicle | 21.5 | |
| 4-hydroxy-6-methyl-1,3,3a,7-tetraazaindene | 2.1 | g/Ag mole |
| Potassium nitrate | 1.8 | |
| Ammonium hexachloropalladate | 0.0022 | |
| Maleic acid hydrazide | 0.0087 | |
| Sorbitol | 0.53 | |
| Glycerin | 0.57 | |
| Potassium bromide | 0.14 | |
| Resorcinol | 0.44 | |
| Bisvinylsulfonylmethylether | 2.4% | based on total gelatin in all layers |
| Crossover Control Emulsion Layer Formulation | | |
| Magenta microcrystalline filter dye (XOC-1) | 2.5 | |
| Gelatin | 6.7 | |
| Low Contrast Emulsion Layer Formulation | | |
| T-grain emulsion (AgBr 3.6 × 0.13 μm) | 7.8 | |
| T-grain emulsion (AgBr 1.2 × 0.13 μm) | 10.1 | |
| Gelatin vehicle | 21.5 | |
| 4-hydroxy-6-methyl-1,3,3a,7-tetraazaindene | 2.1 | g/Ag mole |
| Potassium nitrate | 1.8 | |
| Ammonium hexachloropalladate | 0.0022 | |
| Maleic acid hydrazide | 0.0087 | |
| Sorbitol | 0.53 | |
| Glycerin | 0.57 | |
| Potassium bromide | 0.14 | |
| Resorcinol | 0.44 | |
| Bisvinylsulfonylmethylether | 2.4% | based on total gelatin in all layers |

Radiographic Film B (Control):

Radiographic Film B has the following layer arrangement and formulations. The layers on each side of the support were identical.

| | Coverage (mg/dm$^2$) | |
|---|---|---|
| Overcoat Formulation | | |
| Gelatin vehicle | 3.4 | |
| Methyl methacrylate matte beads | 0.14 | |
| Carboxymethyl casein | 0.57 | |
| Colloidal silica (LUDOX AM) | 0.57 | |
| Polyacrylamide | 0.57 | |
| Chrome alum | 0.025 | |
| Resorcinol | 0.058 | |
| Whale oil lubricant | 0.15 | |
| Interlayer Formulation | | |
| Gelatin vehicle | 3.4 | |
| AgI Lippmann emulsion (0.08 μm) | 0.11 | |
| Carboxymethyl casein | 0.57 | |
| Colloidal silica (LUDOX AM) | 0.57 | |
| Polyacrylamide | 0.57 | |
| Chrome alum | 0.025 | |
| Resorcinol | 0.058 | |
| Nitron | 0.044 | |
| Emulsion Layer Formulation | | |
| T-grain emulsion (AgBr 3.7 × 0.13 μm) | 3.2 | |
| T-grain emulsion (AgBr 2.0 × 0.10 μm) | 9.9 | |
| T-grain emulsion (AgBr 1.2 × 0.13 μm) | 4.1 | |
| Gelatin vehicle | 23.7 | |

-continued

| | Coverage (mg/dm$^2$) | |
|---|---|---|
| 4-hydroxy-6-methyl-1,3,3a,7-tetraazaindene | 2.1 | g/Ag mole |
| Potassium nitrate | 1.8 | |
| Ammonium hexachloropalladate | 0.0022 | |
| Maleic acid hydrazide | 0.0087 | |
| Sorbitol | 0.53 | |
| Glycerin | 0.57 | |
| Potassium bromide | 0.14 | |
| Resorcinol | 0.44 | |
| Bisvinylsulfonylmethylether | 2.4% | based on total gelatin in all layers |

Radiographic Film C (Invention):

Radiographic Film C is within the present invention and had the following layer arrangement and formulations on both sides of the film support:

Overcoat

Interlayer

Upper Emulsion Layer

Lower Emulsion Layer and Crossover Control

| | Coverage (mg/dm$^2$) | |
|---|---|---|
| Overcoat Formulation | | |
| Gelatin vehicle | 3.4 | |
| Methyl methacrylate matte beads | 0.14 | |
| Carboxymethyl casein | 0.57 | |
| Colloidal silica (LUDOX AM) | 0.57 | |
| Polyacrylamide | 0.57 | |
| Chrome alum | 0.025 | |
| Resorcinol | 0.058 | |
| Whale oil lubricant | 0.15 | |
| Interlayer Formulation | | |
| Gelatin vehicle | 3.4 | |
| AgI Lippmann emulsion (0.08 μm) | 0.11 | |
| Carboxymethyl casein | 0.57 | |
| Colloidal silica (LUDOX AM) | 0.57 | |
| Polyacrylamide | 0.57 | |
| Chrome alum | 0.025 | |
| Resorcinol | 0.058 | |
| Nitron | 0.044 | |
| Upper Emulsion Layer Formulation | | |
| T-grain emulsion (AgBr 3.7 × 0.13 μm) | 5.4 | |
| T-grain emulsion (AgBr 2.0 × 0.10 μm) | 5.4 | |
| Gelatin vehicle | 12 | |
| 4-hydroxy-6-methyl-1,3,3a,7-tetraazaindene | 2.1 | g/Ag mole |
| Potassium nitrate | 0.83 | |
| Ammonium hexachloropalladate | 0.001 | |
| Maleic acid hydrazide | 0.0044 | |
| Sorbitol | 0.24 | |
| Glycerin | 0.26 | |
| Potassium bromide | 0.06 | |
| Resorcinol | 0.2 | |
| Bottom Emulsion Formulation | | |
| T-grain emulsion (AgBr 2.0 × 0.10 μm) | 11.2 | |
| Gelatin | 12 | |
| Magenta microcrystalline dye (XOC-1) | 1.08 | |
| 4-hydroxy-6-methyl-1,3,3a,7-tetraazaindene | 2.1 | g/Ag mole |
| Potassium nitrate | 1.1 | |
| Ammonium hexachloropalladate | 0.0013 | |
| Maleic acid hydrazide | 0.0053 | |
| Sorbitol | 0.32 | |
| Glycerin | 0.35 | |
| Potassium bromide | 0.083 | |

-continued

| | Coverage (mg/dm$^2$) |
|---|---|
| Resorcinol | 0.26 |
| Bisvinylsulfonylmethlyether | 2.4% based on total gelatin in all layers |

Samples of Radiographic Films A, B and C were exposed through a graduated density step tablet using a MacBeth sensitometer for 1/50 second and a 500 watt General Electric DMX projector lamp calibrated to 2650° K. filtered with a Coming C4010 filter.

Processing of the exposed film samples for sensitometric evaluation was carried out using a processor commercially available under the trademark KODAK RP X-OMAT film Processor M6A-N. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing for all experiments in this example was carried out using KODAK RP X-OMAT LO Fixer and Replenisher fixing composition (available from Eastman Kodak Company).

Rapid processing has evolved over the last several years as a way to increase productivity in busy hospitals without compromising image quality or sensitometric response. Where 90 second processing times were once the standard, below 40 seconds processing is becoming the standard in medical radiography. One such example of a rapid processing system is the commercially available KODAK Rapid Access (RA) processing system that includes a line of X-ray sensitive films available as T-MAT-RA radiographic films that feature fully forehardened emulsions in order to maximize film diffusion rates and minimize film drying. Processing chemistry for this process is also available. As a result of the film being fully forehardened, glutaraldehyde (a common hardening agent) can be removed from the developer solution, resulting in ecological and safety advantages (see KODAK KWIK Developer below). The developer and fixer designed for this system are Kodak X-OMAT RA/30 chemicals. A commercially available processor that allows for the rapid access capability is the Kodak X-OMAT RA 480 processor. This processor is capable of running in 4 different processing cycles. "Extended" cycle is for 160 seconds, and is used for mammography where longer than normal processing results in higher speed and contrast. "Standard" cycle is 82 seconds, "Rapid Cycle" is 55 seconds and "KWIK/RA" cycle is 40 seconds (see KODAK KWIK Developer below). A proposed new "Super KWIK" cycle is intended to be 30 seconds (see KODAK Super KWIK Developer below). The two KWIK cycles (30 & 40 seconds) use the RA/30 chemistries while the longer time cycles use standard RP X-OMAT chemistry. The following Table I shows typical processing times (seconds) for these various processing cycles.

TABLE I

| Cycle | Extended | Standard | Rapid | KWIK | Super KWIK |
|---|---|---|---|---|---|
| Developer | 44.9 | 27.6 | 15.1 | 11.1 | 8.3 |
| Fixer | 37.5 | 18.3 | 12.9 | 9.4 | 7.0 |
| Wash | 30.1 | 15.5 | 10.4 | 7.6 | 5.6 |
| Drying | 47.5 | 21.0 | 16.6 | 12.2 | 9.1 |
| Total | 160.0 | 82.4 | 55 | 40.3 | 30.0 |

The black-and-white developer useful for the KODAK KWIK cycle contained the following components:

| | |
|---|---|
| Hydroquinone | 32 g |
| 4-Hydroxymethyl-4-methyl-1-phenyl-3-pyrazolidone | 6 g |
| Potassium bromide | 2.25 g |
| 5-Methylbenzotriazole | 0.125 g |
| Sodium sulfite | 160 g |
| Water to 1 liter, pH 10.35 | |

The black-and-white developer used for the KODAK Super KWIK cycle contained the following components:

| | |
|---|---|
| Hydroquinone | 30 g |
| 4-Hydroxymethyl-4-methyl-1-phenyl-3-pyrazolidone | 3 g |
| Phenylmercaptotetrazole | 0.02 g |
| 5-Nitroindazole | 0.02 g |
| Glutaraldehyde | 4.42 g |
| Diethylene glycol | 15 g |
| Sodium bicarbonate | 7.5 g |
| VERSENEX 80 | 2.8 g |
| Potassium sulfite | 71.48 g |
| Sodium sulfite | 11.75 g |
| Water to 1 liter, pH 10.6 | |

The "% Drying" was determined by feeding an exposed film flashed to result in a density of 1.0 into an X-ray processing machine. As the film just exits the drier section, the processing machine was stopped and the film was removed. Roller marks from the processing machine can be seen on the film where the film has not yet dried. Marks from 100% of the rollers in the drier indicate the film has just barely dried. Values less than 100% indicate the film has dried partway into the drier. The lower the value the better the film is for drying.

"Crossover" measurements were obtained by determining the density of the silver developed in each of the silver halide emulsion layers, in the silver halide emulsion layer adjacent the intensifying screen, and in the non-adjacent silver halide emulsion layer separated from the film support. By plotting the density produced by each silver halide emulsion layer versus the steps of a conventional aluminum step wedge (a measure of exposure), a characteristic sensitometric curve was generated for each silver halide emulsion layer. A higher density was produced for a given exposure in the silver halide emulsion layer adjacent the film support. Thus, the two sensitometric curves were offset in speed. At three different density levels in the relatively straight-line portions of the sensitometric curves between the toe and shoulder regions of the curves, the difference in speed ($\Delta$ log E) between the two sensitometric curves was measured. These differences were then averaged and used in the following equation to calculate the % crossover:

$$\% \text{ Crossover} = \frac{1}{\text{antilog}(\Delta \log E) + 1} \times 100$$

Screen Exposures

Radiographic film/intensifying screen imaging assemblies were prepared by placing a screen on both sides of each radiographic Film A, B or C. Each assembly was exposed to 70 KVp X-radiation, varying either current (milliAmperes) or time, using a 3-phase Picker Medical (Model VTX-650) X-ray unit containing filtration up to 3 mm of aluminum. Sensitometric gradations in exposure were achieved by using a 21-increment (0.1 log E) aluminum step wedge of varying thickness.

The data in the following Table II show a relative comparison of the three imaging assemblies A, B and C using radiographic Films A, B and C, respectively. Films A (Control) and C (Invention) provided high resolution imaging assemblies as can be seen by the crossover values of less than 10%. Both Films B and C could be rapidly processed. However, only Film C could be both rapidly processed and exhibit low crossover.

In addition, Film C exhibited a unique sensitometric curve shape in that the upper scale contrast was significantly higher than the lower scale contrast. Film B that is a conventional radiographic film has a typical characteristic curve shape wherein the lower scale and upper scale contrasts are similar in shape. Film A exhibited a higher upper scale contrast than Film B, and the ratio of upper scale contrast to lower scale contrast was greater than 1.0, but it could not be rapidly processed.

Thus, only Film C provides all of the desired properties: low crossover in radiographic imaging assemblies, a ratio of upper scale contrast to lower scale contrast significantly greater than 1.0, and rapid processability. Thus, this radiographic film would demonstrate visually adaptive contrast because it would record information at higher densities with greater reliability and can be better viewed using conventional light boxes.

Figure 2:
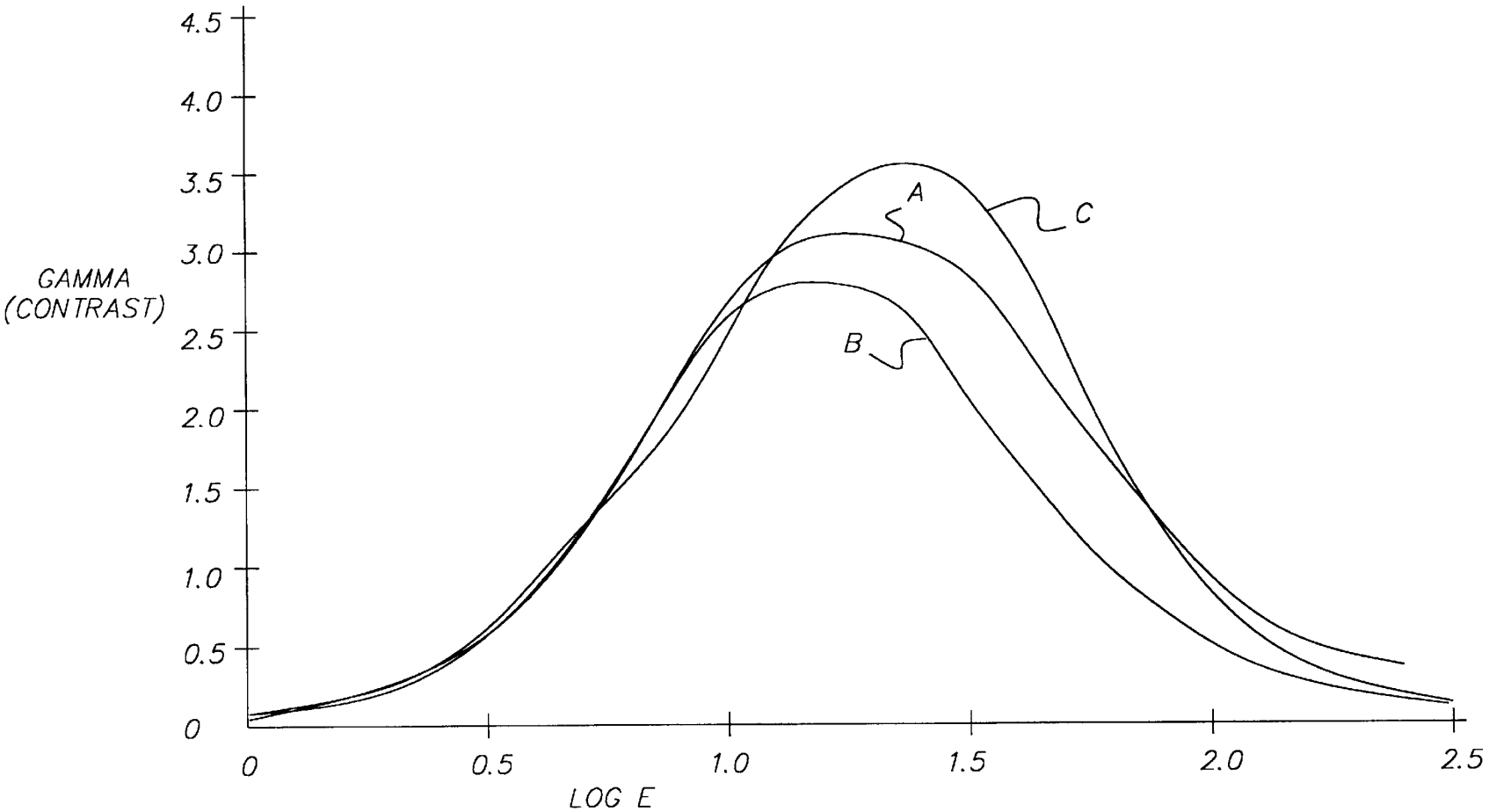
FIG. 2 is a graphical representation of gamma (contrast) vs. log E (exposure) for Films A, B and C of the Example described below.

These results are also apparent from FIGS. 1 and 2 in which Curves A, B and C represent sensitometric data for Films A, B and C respectively.

TABLE II

| Film | Speed | Contrast | % Cross-over | Drying (KWIK Cycle) | LSC* | USC** | Ratio USC/LSC |
|---|---|---|---|---|---|---|---|
| Control A | 0 | 2.4 | 3 | >100% | 1.88 | 2.83 | 1.5 |
| Control B | +0.1 | 2.3 | 30 | 50% | 1.87 | 1.57 | 0.8 |
| Invention C | +0.6 | 2.4 | 7 | 50% | 1.80 | 3.41 | 1.9 |

*LSC = lower scale contrast
**USC = upper scale contrast

As noted previously, one of the benefits of the present invention is that the radiographic films used in the imaging method have sufficient dynamic range that they can be scanned and the images digitized for further manipulation. TABLE III below shows gamma values for each of the noted radiographic imaging assemblies A, B and C (comprising Films A, B and C, respectively) at different densities. All 3 assemblies provide comparable gamma values up to a density of 1.0. However, at higher densities, the values begin to diverge.

Film B begins to lose contrast above a density of 2.0 where useful information can still be recorded. As a result, if Film B is scanned and digitized, it would be very difficult to readjust the exposure level using tone scaling algorithms since the gamma decreases at higher densities. In addition, Film B is difficult to "read" using conventional means because the information at higher densities cannot readily be ascertained by the human eye. Having the gamma value decrease worsens the problem.

Film A provides an improvement over Film B in the respect, but it cannot be rapidly processed. Thus, it limits productivity and the ability to view the image quickly. This is particularly important in intensive care facilities.

Film C provides the greatest exposure latitude (dynamic range), maintaining a high gamma (at least 2.5) up to a density of 2.5 and beyond. Densities of 2.5 or higher are common in radiographic images that are over-exposed. Thus, Film C is suitable for scanning and digitization because of its wide dynamic range for capturing information even when improperly exposed. But it can also be viewed conventional without scanning if desired. The present invention provides flexibility and choices for the medical practitioner so the best medical care can be provided.

Film B was also susceptible to electronic noise during digitization due to its lower upper scale contrast, but Film C exhibited reduced susceptibility to this problem due to its increased upper scale contrast.

The invention has been described in detail with particular reference to preferred embodiments thereof, but it will be understood that variations and modifications can be effected within the spirit and scope of the invention.

We claim:

1. A method for providing a radiographic image comprising:

A) providing a black-and-white image by contacting an imagewise exposed radiographic film with wet processing chemistry, including a black-and-white developing composition, for 90 seconds or less, said black-and-white image having visually adaptive contrast whereby the upper scale contrast is at least 1.2 times the lower scale contrast of a sensitometric D vs. log E curve, and also being capable of maintaining a gamma of at least 2.5 up to 2.5 density units, B) scanning said black-and-white image obtained in A) to form density representative signals, and C) digitally manipulating the density representative signals obtained in B) to produce a digital record, said radiographic silver halide film comprising a support having first and second major surfaces and that is capable of transmitting X-radiation, said film having disposed on the first major support surface, two or more hydrophilic colloid layers including first and second silver halide emulsion layers, and on the second major support surface, two or more hydrophilic colloid layers including third and fourth silver halide emulsion layers, said first and third silver halide emulsion layers being closer to the support than said second and fourth silver halide emulsion layers, respectively, each of said first, second, third and fourth silver halide emulsion layers comprising silver halide grains that (a) have the same or different composition in each silver halide emulsion layer, (b) account for at least 50% of the total grain projected area within each silver halide emulsion layer, (c) have an average thickness of less than 0.3 $\mu$m, and (d) have an average aspect ratio of greater than 5, all hydrophilic layers of said film being fully forehardened and wet processing solution permeable for image formation within 45 seconds, said first and third silver halide emulsion layers comprising at least one particulate dye that is (a) capable of absorbing radiation to which the silver halide emulsions are sensitive, (b) present in an amount sufficient to reduce crossover to less than 15%, and (c) capable of being substantially decolorized during wet processing.

2. The method of claim 1 wherein said black-and-white developing composition is free of any photographic film hardeners.

3. The method of claim 1 wherein said particulate dye is present in said film in an amount sufficient to reduce crossover to less than 10%.

4. The method of claim 1 wherein said film is capable of providing a black-and-white image with visually adaptive contrast whereby said upper level contrast is at least 1.6 times said lower scale contrast.

5. The method of claim 1 wherein said silver halide grains of each silver halide emulsion are tabular silver halide grains composed of at least 80% bromide based on total silver.

6. The method of claim 5 wherein the tabular silver halide grains of each silver halide emulsion are composed of at least 98% bromide based on total silver.

7. The method of claim 1 wherein said silver halide grains are tabular grains having an ECD of from about 1.6 to about 4.5 $\mu$m, and an average thickness of from about 0.1 to about 0.18 $\mu$m.

8. The method of claim 7 wherein at least 90% of the silver halide grain projected area in each silver halide emulsion layer is provided by tabular silver halide grains having an aspect ratio greater than 10.

9. The method of claim 1 wherein said particulate dye is present in said film in an amount of from about 0.5 to about 2 mg/dm$^2$.

10. The method of claim 1 wherein said film further comprises an overcoat over said silver halide emulsions on each side of said film support.

11. The film of claim 1 wherein the total polymer vehicle on each side is no more than 35 mg/dm$^2$.

12. The film of claim 11 wherein the total polymer vehicle on each side is from about 20 to about 35 mg/dm$^2$.

13. The method of claim 1 wherein said film is provided for A) in a radiographic imaging assembly comprising an intensifying screen on either side of said film.

14. The method of claim 1 wherein said digital record is transmitted to an output device.

15. The method of claim 14 wherein said digital record is transmitted to an output display device.

16. The method of claim 1 wherein said film is at least partially fixed before B).

17. The method of claim 1 wherein A) is carried out from about 30 to about 90 seconds.

* * * * *